US008678840B2

(12) United States Patent
Donhauser et al.

(10) Patent No.: US 8,678,840 B2
(45) Date of Patent: Mar. 25, 2014

(54) LOCKING ARRANGEMENT HAVING A SLIDE TO MOVE A SNAP HOOK WITH A SLOT FOR ENGAGING A CATCH

(75) Inventors: Peter Donhauser, Amberg (DE); Gennadij Drehmann, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/300,301

(22) Filed: Nov. 18, 2011

(65) Prior Publication Data

US 2012/0129380 A1 May 24, 2012

(30) Foreign Application Priority Data

Nov. 18, 2010 (EP) ..... 10191657

(51) Int. Cl.
*H01R 13/62* (2006.01)
*H01R 13/64* (2006.01)

(52) U.S. Cl.
USPC ..... 439/157; 439/372

(58) Field of Classification Search
USPC ..... 439/157–160, 350–372
See application file for complete search history.

(56) References Cited

U.S. PATENT DOCUMENTS

| | | | | |
|---|---|---|---|---|
| 4,693,533 | A * | 9/1987 | Szczesny et al. | 439/350 |
| 5,104,331 | A | 4/1992 | Goble | |
| 5,613,870 | A * | 3/1997 | Traver, Jr. | 439/352 |
| 5,957,708 | A * | 9/1999 | Lin | 439/157 |
| 6,439,918 | B1 * | 8/2002 | Togami et al. | 439/372 |
| 6,644,991 | B2 * | 11/2003 | Martin | 439/157 |
| 6,955,550 | B2 * | 10/2005 | Schlack | 439/160 |
| 7,114,984 | B2 * | 10/2006 | Shirk et al. | 439/372 |
| 7,462,063 | B1 * | 12/2008 | Correll | 439/460 |
| 7,771,225 | B1 * | 8/2010 | Wu | 439/352 |
| 7,798,838 | B2 * | 9/2010 | Grieff et al. | 439/346 |
| 8,152,556 | B2 * | 4/2012 | Wu | 439/357 |
| 8,169,783 | B2 * | 5/2012 | Phillips et al. | 361/728 |
| 2005/0003696 | A1 * | 1/2005 | Shirk et al. | 439/352 |
| 2008/0139038 | A1 | 6/2008 | Lee | |

FOREIGN PATENT DOCUMENTS

| | | |
|---|---|---|
| DE | 19716917 | 4/1998 |
| WO | WO 0213326 | 2/2002 |

* cited by examiner

*Primary Examiner* — Chandrika Prasad
(74) *Attorney, Agent, or Firm* — Cozen O'Connor

(57) ABSTRACT

A locking arrangement for a plug apparatus which can be swiveled into an electronic assembly with an unlocking slide fastened to the plug apparatus, and is in operative connection with a snap hook arranged on a catch.

11 Claims, 6 Drawing Sheets

LOCKING ARRANGEMENT HAVING A SLIDE TO MOVE A SNAP HOOK WITH A SLOT FOR ENGAGING A CATCH

BACKGROUND OF THE INVENTION

1. Field of the Invention

The invention relates to locking devices and, more particularly, to a locking arrangement for a plug apparatus which can be swiveled into an electronic assembly, comprising an unlocking slide which is fastened to the plug apparatus and is in operative connection with a snap hook, which is arranged on a catch.

2. Description of the Related Art

The connection of electronic assemblies, i.e., peripheral assemblies in automation systems, is usually performed by plug apparatuses, i.e., front-panel connectors, which contact the corresponding process via quasi-fixed wiring with the peripherals. Therefore, in the event of an assembly exchange only the front-panel connectors need to be removed and no lines released.

Printed circuit boards, assemblies or plug-in boards for electronic control devices are used advantageously in standardized housings. A sub rack accommodates the assemblies that can be plugged in along guide rails. The assemblies are supplied with electricity or signals through contacts that are attached to either the front side or backwards/sideways. The wiring of the assemblies to each other can also be performed from the reverse side.

The housings have fixed dimensions, serve to accommodate printed circuit boards, and are installed in standardized control cabinets. A housing is composed of two side panels with mounting arms that are connected to each other by four string profiles. The housing is screwed into an electronic cabinet by the two mounting arms.

Plug-in units inserted into the housing, such as printed circuit boards, are controlled by external process signals or are connected to other plug-in units. Connectors, i.e., front-panel connectors comprising push-on terminal strips that are pushed onto the plug-in units from the operating side, are used for this purpose. When selecting the connectors, besides the economy and the required contact pins, above all attention must be paid to the reliability of the connector, mechanical strength, the ability to combine parts supplied by different manufacturers, insulating properties and current load. The connectors generally used for direct connection meet all the requirements for economy and reliability. However, the number of contact pins is often insufficient. The process front panel connector is used above all for peripheral devices if for example, a physical separation of the cables from the internal electronic signal lines is advisable to avoid electrical interference.

The disadvantage of the prior art, however, is that where excess force is used to unlock the plug apparatus from the sub-rack in the event of emergency unlocking, the locking system is often damaged. This results in the plug apparatus and the assembly no longer locking with each other so that this type of unlocking is only possible once.

SUMMARY OF THE INVENTION

It is therefore an object of the invention to provide a locking arrangement for a plug apparatus of an electronic assembly that enables repeated emergency unlocking, without destroying the locking elements.

This and other objects and advantages are achieved by a locking arrangement for a plug apparatus which can be swiveled about a pivot point into an electronic assembly, with an unlocking slide that is fastened to the plug apparatus and is in operative connection with a snap that is arranged on a catch. In accordance with the invention, the snap hook is designed with a slot. In accordance with the invention, the plug apparatus is inserted into the plug storage in the lower area of the electronic assembly and then swiveled about the pivot point into contact with the contact blades of the assembly and locked to the assembly in the upper area. A snap hook serves as a locking arrangement that engages behind the catch. By drawing on the unlocking slide of the plug apparatus, the snap hook is deflected, as a result of which the system is unlocked and the plug apparatus is drawn from the contact blades of the assembly. So that the plug apparatus can lock again during the next swiveling process, the unlocking slide is brought into the starting position again using spring elasticity, where the snap hook is also able to re-assume its original position.

It is furthermore provided that the locking elements comprising a catch and snap hook overlap during locking and constitute a connection. Usually, the locking mechanism must be released, i.e., unlocked, before the plug apparatus can be pulled out of the assembly. During proper unlocking, at least one partner, i.e., catch or snap hook, must be deflected so that the system can be released without damage. The core of the invention consists here of repeated emergency unlocking being possible, without damaging the locking elements. For this, the snap hook is provided with a slot in accordance with the invention and has the option of being deflected in two directions, i.e., vertically as well as horizontally. In the event that too much force is exerted on the connection cable in the upper area of the plug apparatus when routing the line, the plug apparatus can be removed from the assembly without being unlocked. In order to prevent the locking system from being damaged, the snap hook deflects automatically. The snap hook is manufactured such that it forms a sufficient rear grip with the catch and the overreach on the catch and snap hook enables the deflection of the arm through angles. The angles are adjusted such that the load opens the locking mechanism without destruction. Through the slot the snap hook in accordance with the invention is provided with two arms that act as torsion rod springs and release the locking system without being damaged in the process. After loading, the arms take up their original position to the greatest possible extent, and the plug apparatus can be re-engaged with the assembly. In the housing of the new locking technique in accordance with the invention, the two arms of the snap hook open. After loading, the two arms return to their starting position as far as possible and the plug apparatus can be re-engaged with the electronic assembly. The locking system is not damaged, i.e., the plug apparatus and the assembly can continue to engage with each other as a result of emergency unlocking.

In a particularly advantageous embodiment, the plug apparatus swivels into contact with the electronic assembly. Here, the plug apparatus is preferably swivels into contact with a front-panel connector on the electronic assembly, and a locking element which enables locking in the upper area of the plug apparatus is provided. The plug apparatus in accordance with the present embodiment is configured to swivel, as a result of which insertion and drawing forces are reduced.

In accordance with the contemplated embodiment of the invention, a plug storage area is responsible for pre-wiring and a second plug storage area for contacting. Here, the plug apparatus engages firmly in the pre-wiring position with the electronic assembly. This is managed by a locking system. By means of journals, which otherwise serve as feeder cams, the plug apparatus is hung in the pre-grid position where it swivels to engage with the electronic assembly. The locking mechanism on the plug apparatus also engages the plug with the assembly in this position. The terminals are also in this plug position, i.e., the motherboard, outside the electronic assembly and are easily accessible. The contact system of sockets and blades is not yet engaged.

In a particular advantageous embodiment, by drawing on the unlocking slide of the plug apparatus, the snap hook can be deflected and the plug apparatus unlocked, so that this can be swung out from the assembly. In the process, it is particularly advantageous that the unlocking slide can be returned to its starting position before swiveling by spring elasticity, where the snap hook re-assures its original position.

Another major advantage of the locking arrangement of the disclosed embodiments of the invention particularly consists in the locking arrangement having non-destructive emergency unlocking. To this end, the snap hook is provided with a slot and has the option of being deflected in two directions, vertically as well as horizontally. In the event that too much force is exerted on the connection cable in the upper area of the plug apparatus when routing the line, the plug apparatus can be taken out of the assembly without being unlocked. To prevent the locking system from being damaged in the process, the snap hook automatically deflects. The snap hook is manufactured such that it forms a sufficient rear grip with the catch, and the overreach on the catch and snap hook enables the deflection of the arm through angles. The angles are adjusted such that the load opens the locking mechanism without destruction.

In a particular embodiment, the snap hook can be swung out in a vertical direction. The vertical orientation is produced by spontaneous emergency unlocking. The slotted snap hook has two arms which swing away to the left and right during spontaneous unlocking. This constitutes a vertical deflection.

In a particular embodiment, the snap hook can be deflected in a horizontal direction. The horizontal orientation is produced during normal unlocking without excessive effort. In the process, the snap hook slips down horizontally so that it is led past the catch. This results in an unlocked status.

The locking arrangement in accordance with the disclosed embodiments of the invention is used in particular in plug apparatuses, preferably in front-panel connectors of electronic assemblies in automation technology.

The locking arrangement in accordance with the disclosed embodiments of the invention for a plug apparatus of an electronic assembly in automation technology enables repeated emergency unlocking without destroying the locking elements. The locking elements in accordance with the disclosed embodiments of the invention are configured as a snap hook and catch, where it is possible to swing the snap hook out in two directions, i.e., in a vertical and in a horizontal direction. This enables repeated use of this locking arrangement, after the plug apparatus is led to the module again.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and embodiments of the invention are explained below with the aid of exemplary embodiments and with the aid of a drawing, in which.

DETAILED DESCRIPTION OF THE PREFERRED EMBODIMENTS

Figure 1:
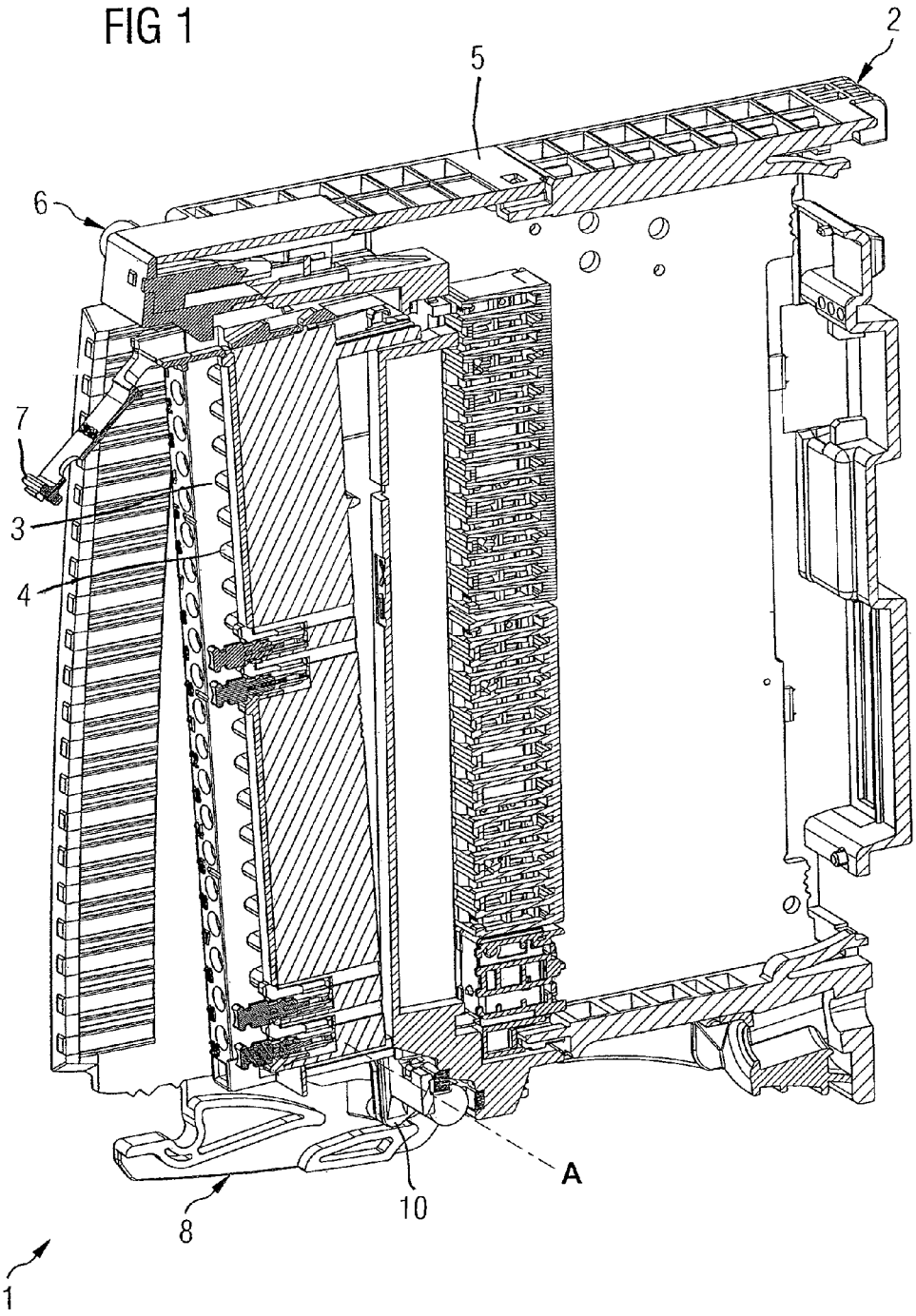
FIG. 1 is a perspective cross-sectional view illustration of a plug apparatus with locking arrangement in accordance with the invention in an electronic assembly.

FIG. 1 shows a plug apparatus 1 with a locking arrangement in accordance with the invention in an electronic assembly 2. The plug apparatus 1 has a connector panel 3 with slots 4 for electric leads. The electronic assembly 2 has a preferably cuboid housing 5, which is open on one side so that the plug apparatus 1 can preferably be introduced using a swivel technique centered about pivot point A. The housing 5 can be designed in two parts with a bonnet in the area of the plug apparatus 1 and a basic housing connecting to this bonnet. The plug apparatus 1 has an unlocking slide 7 in the upper area in the vicinity of the housing cover area 6 of the assembly 2. The unlocking slide 7 can swing out to the front so that it is at an angle of approx. 90° to the plug apparatus 1. There is both a pre-wiring storage position 9 and a contact storage position 10 in the area of the housing floor 8 of the assembly 2.

Figure 2A:
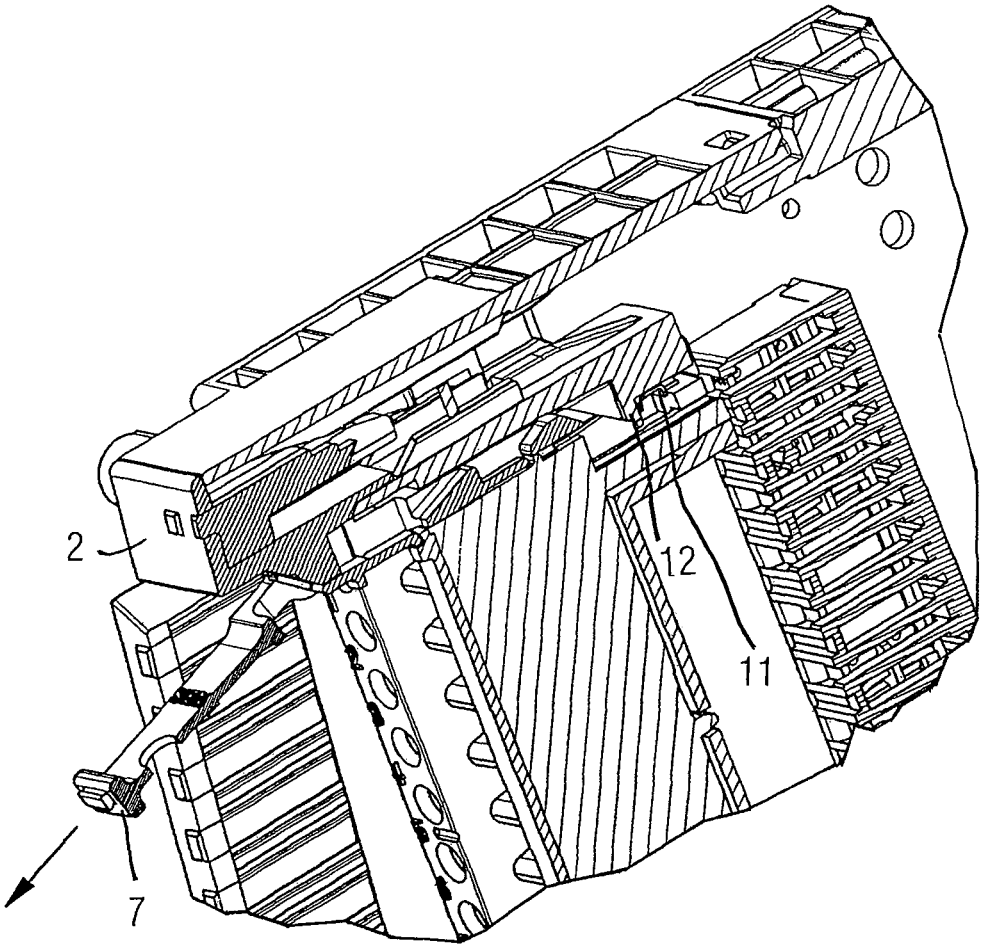
FIGS. 2A and 2B a perspective are cross-sectional views of the locking arrangement in accordance with the invention with an unlocking slide and two locking elements comprising a snap hook and catch.
Figure 2B:
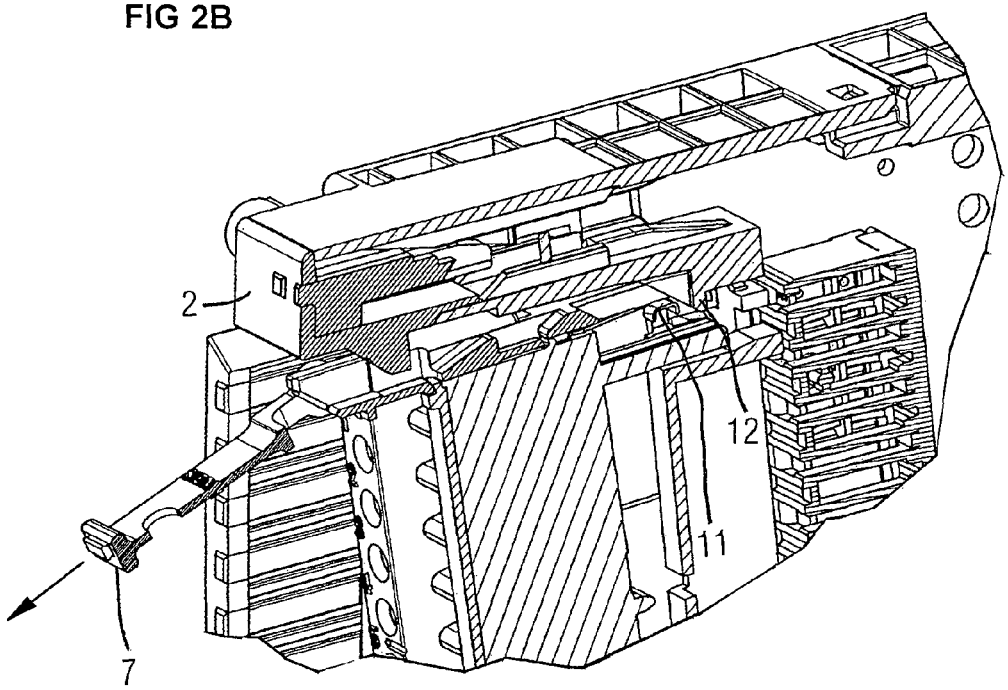
Figure 3:
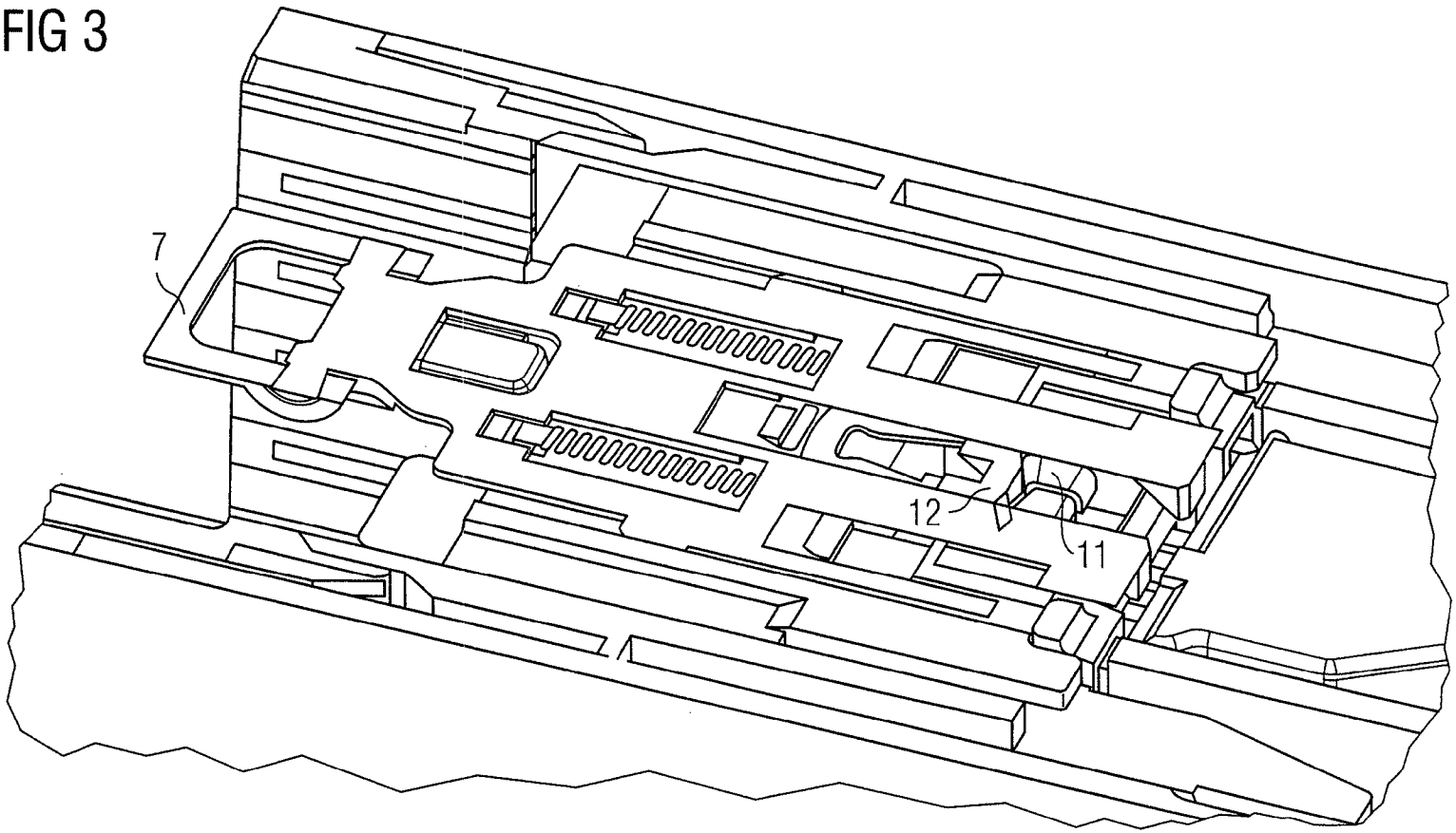
FIG. 3 is a perspective view illustration of the interaction between the unlocking slide, catch and snap hook shown in FIG. 2.

In FIGS. 2A and 2B, the locking arrangement in accordance with the invention is shown with the unlocking slide 7 and preferably two locking elements comprising snap hook 11 and catch 12. The unlocking slide 7 is in operative connection with the snap hook 11, which for its part leans against the catch 12. In a normal unlocking process, it is envisaged in accordance with the invention that the snap hook 11 moves in a vertical direction corresponding to the arrow and is thus led past the catch 12. The catch 12 is formed of contours in the housing of the electronic assembly 2. FIG. 2A shows the snap hook 11 and the catch 12 in the locked position, while FIG. 2B shows the snap hook 11 and the catch 12 in the unlocked position. The interaction between the unlocking slide 7, catch 12 and snap hook 11 is also shown again in FIG. 3.

Figure 4:
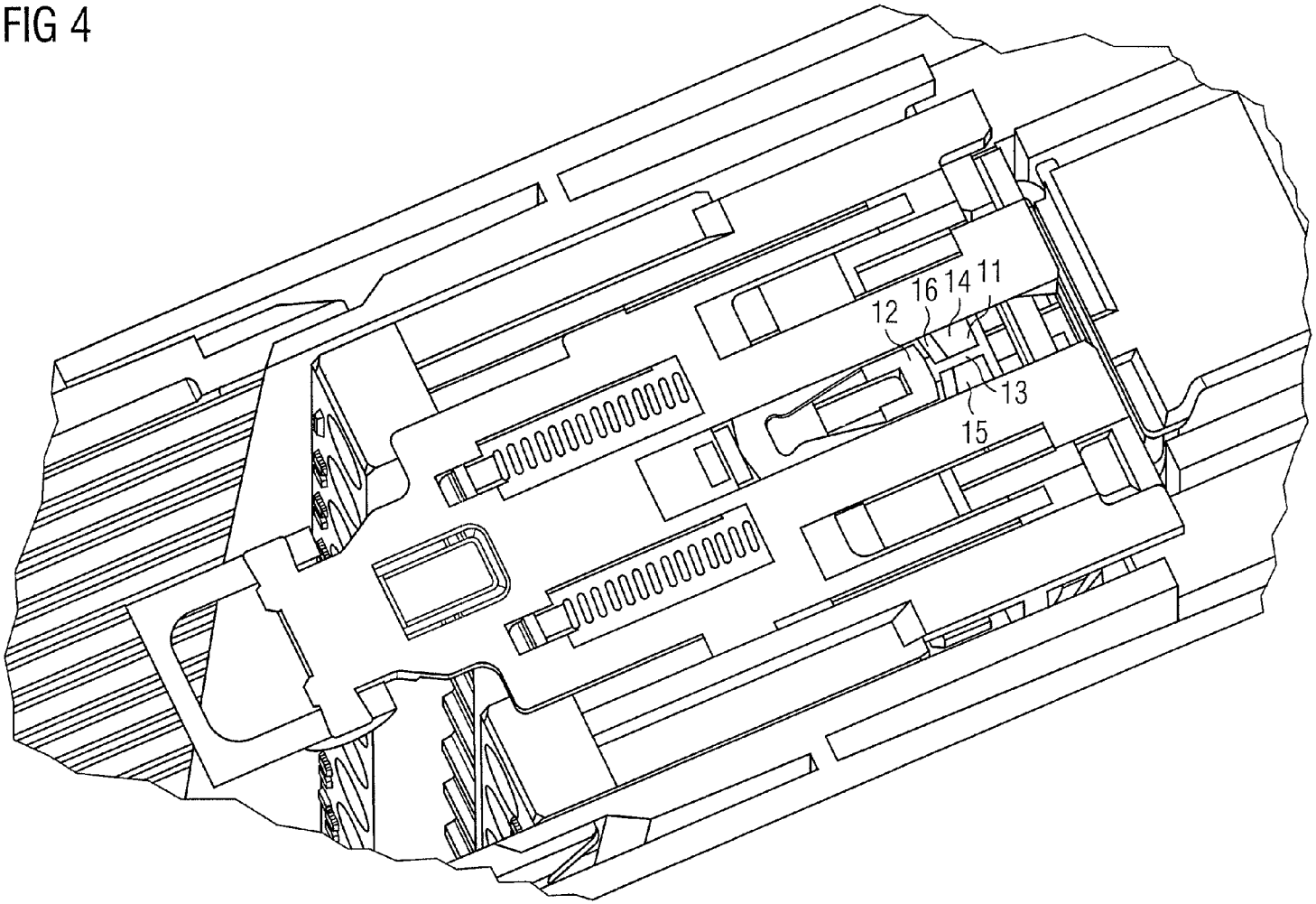
FIG. 4 is a perspective view illustration of the snap hook in accordance with the invention with a slot and two outwardly extending arms with guide edges diagonal to the catch.

FIG. 4 shows the snap hook 11 in accordance with the invention, which has a slot 13 and the two outwardly extending arms 14, 15 that have contact edges 16 diagonal to the catch 12.

Figure 5:
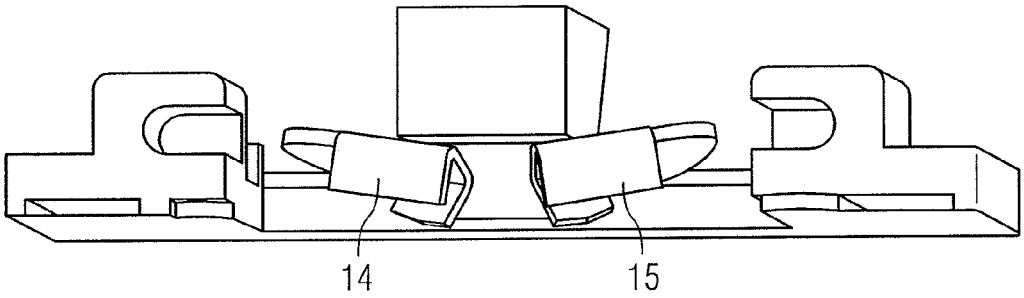
FIG. 5 is a perspective view illustration of the horizontal rotation of the two arms of the snap hook shown in FIG. 2 in the housing of emergency unlocking.

In FIG. 5 the horizontal rotation of the two outwardly extending arms 14, 15 of the snap hook 11 is shown in the housing of emergency unlocking. The two outwardly extending arms 14, 15 act as torsion rod springs, as a result of which the locking system is released without being damaged in the process. After loading, the two outwardly extending arms 14, 15 assume their original position to the greatest possible extent and the plug apparatus can be re-engaged with the assembly 2. With the locking technique in accordance with the invention, the two outwardly extending arms 14, 15 of the snap hook 11 open. After loading, the two outwardly extending arms 14, 15 return to their starting position as far as possible, and the plug apparatus can be re-engaged with the electronic assembly. The locking system is not damaged, i.e., the plug apparatus and the assembly can continue to engage with each other as a result of emergency unlocking.

The locking arrangement in accordance with the invention for a plug apparatus of an electronic assembly in automation technology enables repeated emergency unlocking, without destroying the locking elements. The locking elements in accordance with the invention are configured as a snap hook and catch, where it is possible to swing the snap hook out in two directions, i.e., in a vertical and in a horizontal direction. As a result, the repeated use of this locking arrangement is provided, after the plug apparatus is led to the assembly again.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A locking arrangement for a plug apparatus which swivels into an electronic assembly, comprising:

a catch connected to the electronic assembly;

a snap hook including a slot and engaging with the catch in a locked position; and an unlocking slide fastened to the plug apparatus and in operative connection with the snap hook.

2. The locking arrangement as claimed in claim 1, wherein the plug apparatus swivels to contact the electronic assembly.

3. The locking arrangement as claimed in claim 1, wherein, by pulling on the unlocking slide of the plug apparatus, the snap hook is deflectable around the catch so that the plug apparatus becomes unlocked so that the plug apparatus swings outwardly from the electronic assembly.

4. The locking arrangement as claimed in claim 2, wherein by pulling on the unlocking slide of the plug apparatus, the snap hook is deflectable around the catch so that the plug apparatus becomes unlocked so that the plug apparatus swings outwardly from the electronic assembly.

5. The locking arrangement as claimed in claim 3, wherein the snap hook is elastic so as to reassume its original position after deflection.

6. The locking arrangement as claimed in claim 1, wherein the snap hook is configured to move in a vertical direction.

7. The locking arrangement as claimed in claim 1, wherein the snap hook is configured to move out of the engagement with the catch in a horizontal direction.

8. The plug apparatus as claimed in claim 1, wherein the plug apparatus comprises a front-panel connector.

9. The plug apparatus as claimed in claim 1, wherein the snap hook comprises two arms with the slot between the arms.

10. The plug apparatus as claimed in claim 9, wherein, by pulling on the unlocking slide, the two arms deflect from an original position around the catch allowing the plug apparatus to move outwardly from the electronic assembly.

11. The plug apparatus as claimed in claim 10, wherein the two arms are elastic so as to return to an original position of the two arms to provide the locking arrangement.

* * * * *